US010450814B2

(12) United States Patent
Jones

(10) Patent No.: US 10,450,814 B2
(45) Date of Patent: Oct. 22, 2019

(54) SINGLE BALL ACTIVATED HYDRAULIC CIRCULATING TOOL

(71) Applicant: Tenax Energy Solutions, LLC, Clinton, OK (US)

(72) Inventor: Kevin Dewayne Jones, Clinton, OK (US)

(73) Assignee: Tenax Energy Solutions, LLC, Clinton, OK (US)

( * ) Notice: Subject to any disclaimer, the term of this patent is extended or adjusted under 35 U.S.C. 154(b) by 109 days.

(21) Appl. No.: 15/646,517

(22) Filed: Jul. 11, 2017

(65) Prior Publication Data

US 2018/0010406 A1 Jan. 11, 2018

Related U.S. Application Data

(60) Provisional application No. 62/360,604, filed on Jul. 11, 2016.

(51) Int. Cl.
*E21B 21/10* (2006.01)
*E21B 34/00* (2006.01)
*E21B 21/12* (2006.01)

(52) U.S. Cl.
CPC ..... *E21B 21/103* (2013.01); *E21B 21/12* (2013.01); *E21B 2034/007* (2013.01)

(58) Field of Classification Search
CPC ..... E21B 34/14; E21B 21/103
See application file for complete search history.

(56) References Cited

U.S. PATENT DOCUMENTS 3,054,415 A * 9/1962 Baker ..... E21B 34/14 137/625.38
3,799,278 A * 3/1974 Oliver ..... E21B 21/103 175/237
4,520,870 A * 6/1985 Pringle ..... E21B 34/14 166/239
4,685,520 A * 8/1987 McDaniel ..... E21B 21/103 166/301
5,960,881 A * 10/1999 Allamon ..... E21B 21/103 166/285
7,677,304 B1 * 3/2010 Smith ..... E21B 34/06 166/237
8,522,877 B2 * 9/2013 Chambers ..... E21B 34/14 166/323

(Continued)

*Primary Examiner* — Shane Bomar
(74) *Attorney, Agent, or Firm* — Tomlinson McKinstry, P.C.

(57) ABSTRACT

A circulating sub having an elongate outer member and an elongate inner member positioned within the outer member. Locking members releasably maintain the inner and outer members in a longitudinally fixed relationship. The sub may be activated by a single ball. The ball engages with the locking members and unlocks the inner member from the outer member. The increase of fluid pressure within the sub causes the inner member to move downward within the outer member. Downward movement of the inner member opens exit ports on the outer member to allow fluid to flow into a wellbore surrounding the sub. The decrease of fluid pressure within the sub causes the inner member to move upward within the outer member. Upward movement of the inner member seals the exit ports and deactivates the sub. Once the sub is deactivated, the ball may be expelled from the sub.

16 Claims, 5 Drawing Sheets

(56) References Cited

U.S. PATENT DOCUMENTS

| | | | | |
|---|---|---|---|---|
| 8,657,009 | B2 | 2/2014 | Themig et al. | |
| 8,657,018 | B2 | 2/2014 | Cravatte | |
| 2005/0072572 | A1* | 4/2005 | Churchill | E21B 21/103 166/319 |
| 2008/0093080 | A1* | 4/2008 | Palmer | E21B 21/103 166/318 |
| 2011/0278017 | A1* | 11/2011 | Themig | E21B 34/14 166/373 |
| 2013/0133949 | A1* | 5/2013 | Xu | E21B 10/322 175/40 |
| 2013/0299184 | A1* | 11/2013 | Ali | E21B 34/14 166/373 |
| 2015/0068763 | A1* | 3/2015 | Jepp | E21B 34/14 166/373 |
| 2015/0361764 | A1* | 12/2015 | Cronley | E21B 34/10 166/255.2 |
| 2019/0003283 | A1* | 1/2019 | Atkins | E21B 21/103 |

* cited by examiner

SINGLE BALL ACTIVATED HYDRAULIC CIRCULATING TOOL

CROSS REFERENCE TO RELATED APPLICATION

This application claims the benefit of U.S. Provisional Patent Application No. 62/360,604, filed Jul. 11, 2016, the entire contents of which are incorporated herein by reference.

SUMMARY

The present invention is directed to a circulating sub. The sub comprises an elongate outer member having a longitudinal internal bore extending therethrough and at least one exit port, and an elongate inner member disposed within the internal bore and having an internal channel extending therethrough, in which a nozzle is formed within the channel. The sub further comprises a plurality of locking elements adapted to releasably maintain the inner and outer members in a longitudinally fixed relationship. Each locking element comprises an elongate arm having a projecting ear positionable within a groove formed within the internal bore, and a catch member attached to the arm and partially extending within the channel.

The inner member of the sub is configured to move relative the outer body such that the inner member is movable between: (1) a locked position, in which fluid does not pass through the exit port; and (2) an open position, in which fluid passes through the exit port.

DETAILED DESCRIPTION

In oil and gas drilling operations, it is important to keep fluid circulating within the wellbore to maintain effective pressure and to keep the drill string and drill bit cooled and lubricated. In some cases, the fluid may flow into one or more geological formations surrounding the wellbore, leading to a decrease in fluid circulation. Circulation will need to be increased within the wellbore when this occurs.

Figure 1:
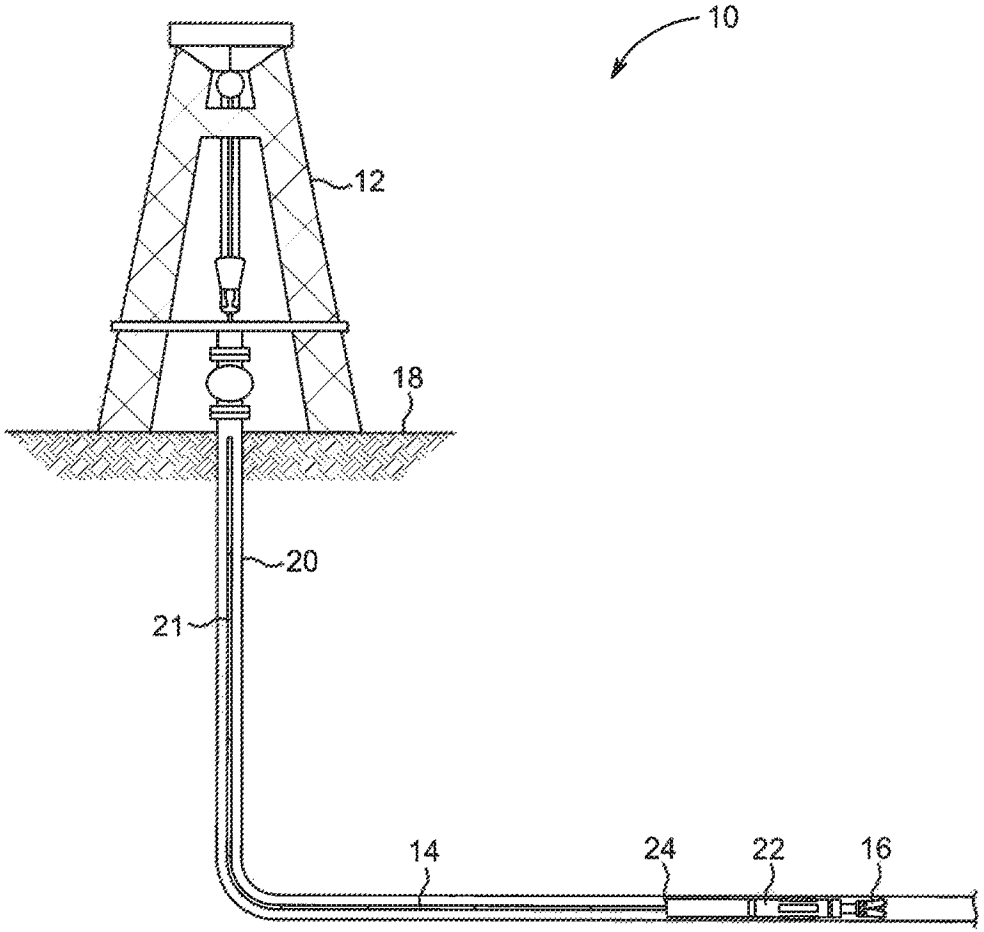
FIG. 1 is a schematic view of a drilling system formed from a series of interconnected rigid pipe sections.

FIG. 1 shows a schematic view of a drilling system to used in oil and gas drilling operations. The drilling system 10 comprises surface equipment 12, an elongate tubular string or drill string 14, and a drill bit 16. The surface equipment 12 sits on a ground surface 18. The drill string 14 and the drill bit 16 are shown underground within a wellbore 20. The drill string 14 is made up of a plurality of rigid pipe sections 21 attached end to end.

The drilling system to works to advance the drill string 14 and the drill bit 16 down the wellbore 20 during drilling operations by rotating the drill string 14 and the drill bit 16. A bottom hole assembly 22 is connected to a terminal end 24 of the drill string 14 prior to the drill bit 16. The bottom hole assembly 22 may comprise one or more tools used in drilling operations, such as a circulation sub, mud motors, telemetry equipment, hammers, etc. During operation, fluid may be pumped down the drill string 14 and exit the drill bit 16 in order to flow into the wellbore 20.

Figure 2:
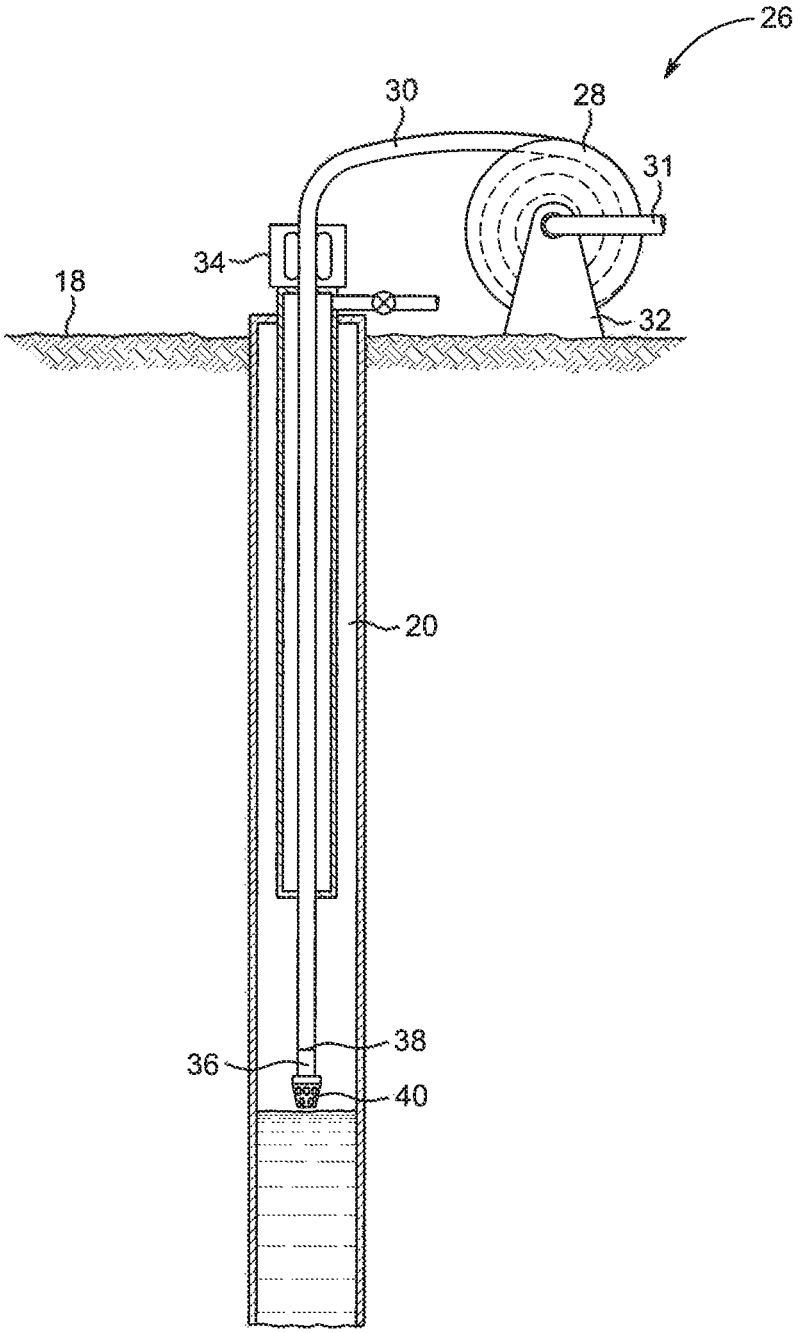
FIG. 2 is a schematic view of a drilling system formed from coiled tubing.

FIG. 2 shows a schematic view of a coiled tubing drilling system 26 used in oil and gas drilling operations. The coiled tubing system 26 comprises surface equipment positioned at the ground surface 18. The surface equipment comprises a spool 28 of an elongate tubular string or coiled tubing 30 attached to a reel 32. The coiled tubing 30 is generally a very long metal pipe that may be between 1-4 inches in diameter. The coiled tubing 30 is advanced along the wellbore 20 using an injector head 34. A bottom hole assembly 36 may be attached to a terminal end 38 of the coiled tubing 30. A drill bit 40 is attached to the bottom hole assembly 36 within the wellbore 20, in FIG. 2. During operation, fluid may be pumped down the coiled tubing 30 and exit the drill bit 40 in order to flow into the wellbore 20.

Figure 3:
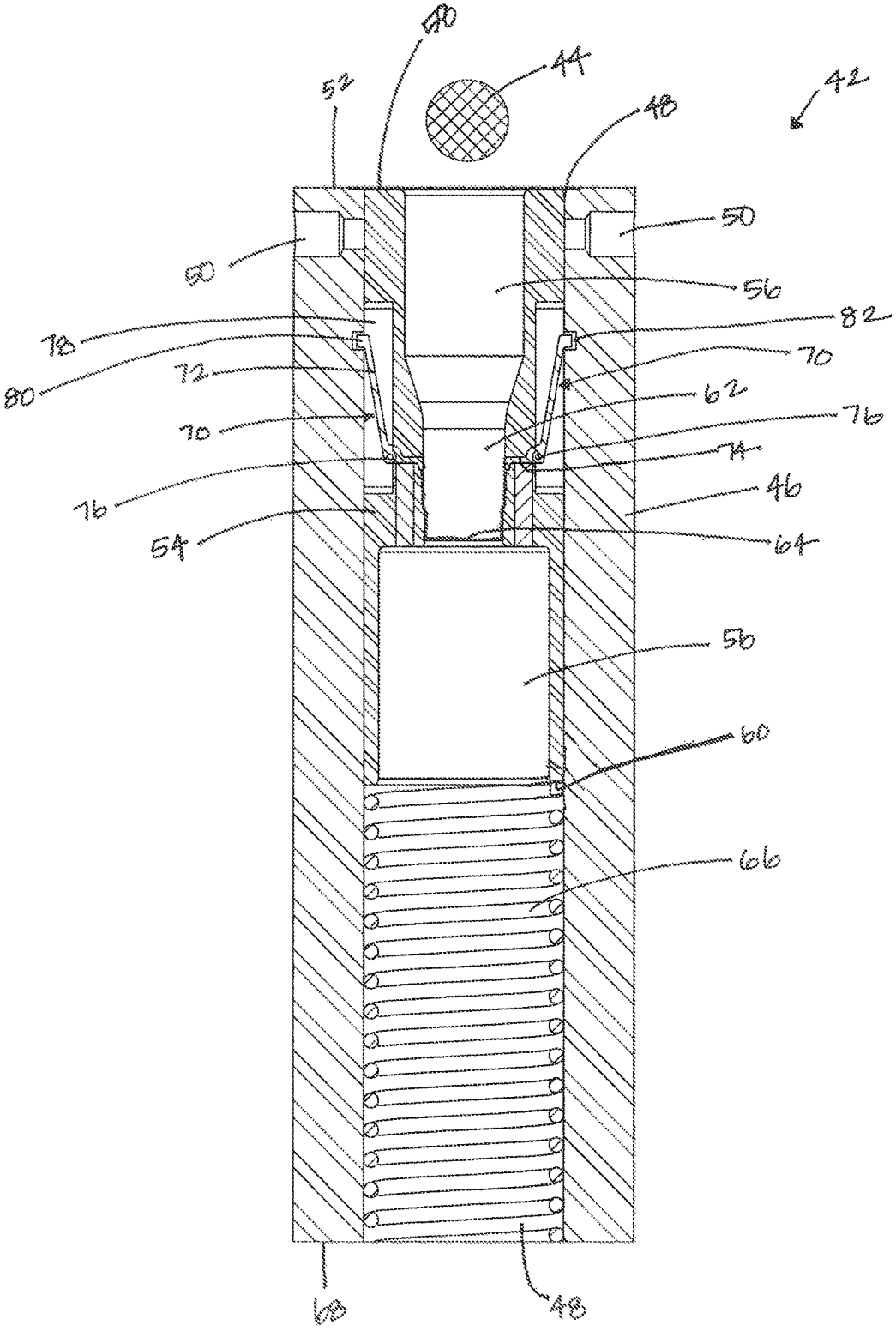
FIG. 3 is cross-sectional view of a circulation sub. The cross-section is taken along the longitudinal axis of the sub. The sub is shown in the locked position.
Figure 4:
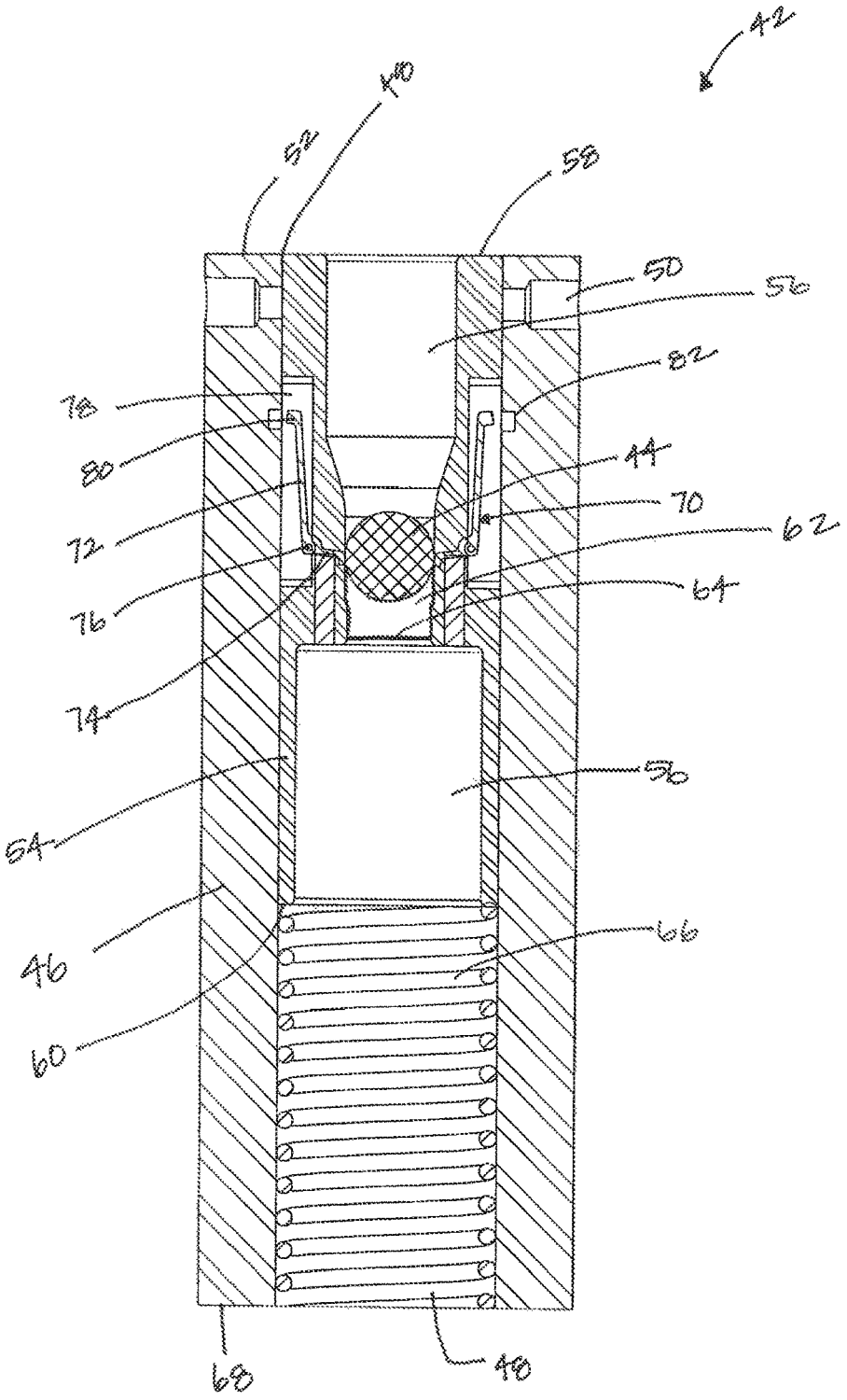
FIG. 4 is the view of FIG. 3 with the sub shown in the intermediate position.
Figure 5:
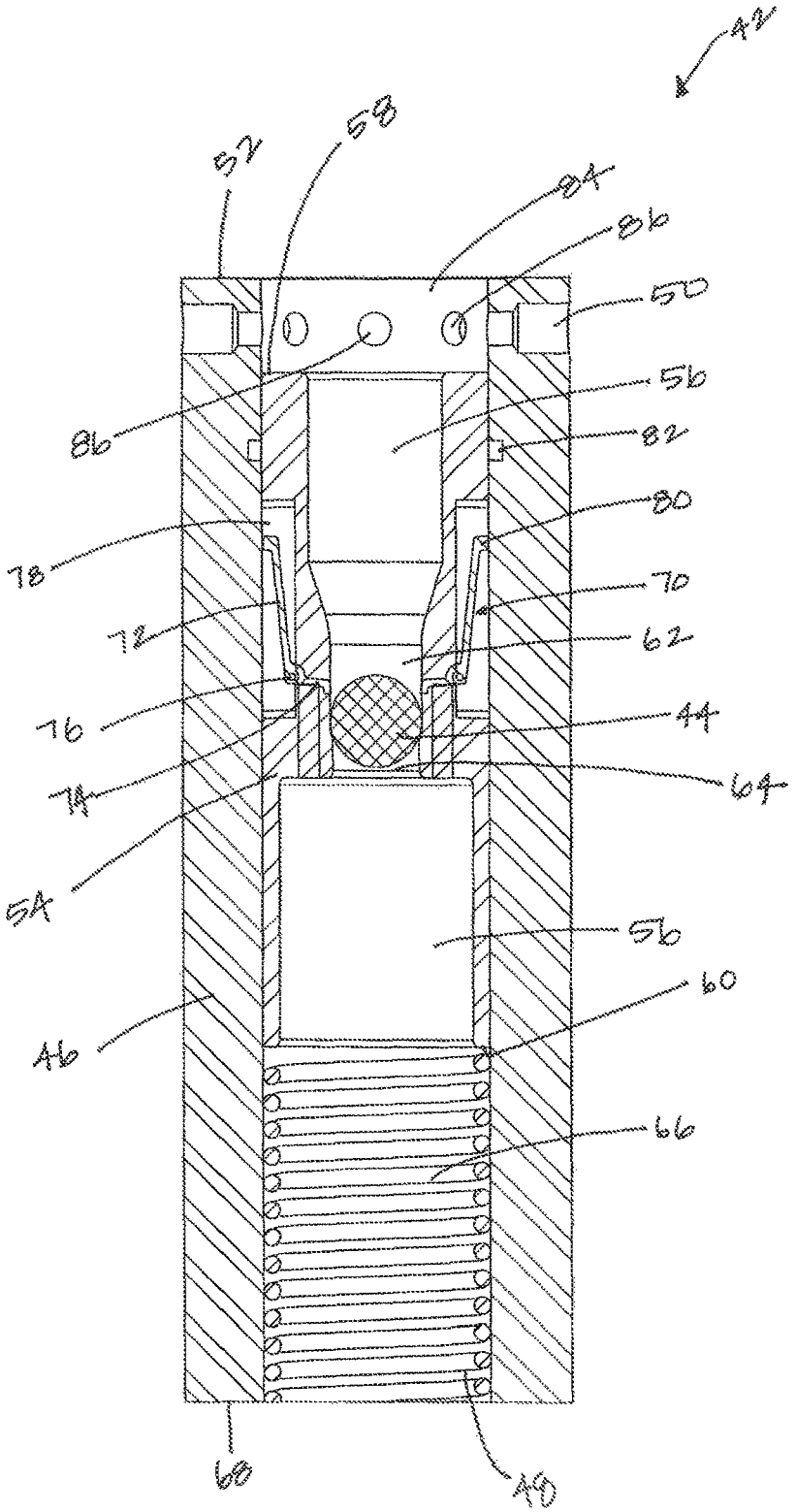
FIG. 5 is the view of FIG. 3 with the sub shown in the open position.

Turning now to FIGS. 3-5, a circulation sub 42 is shown. The circulation sub 42 may be one of the downhole tools included in the bottom hole assembly 22 or 36 shown in FIGS. 1-2. The circulation sub 42 directs fluid from the drill string 14 or coiled tubing 30 to flow into the wellbore 20 up-hole from the drill bit 16 or 40. This helps increase circulation within the wellbore 20 if circulation has been decreased or lost.

The sub 42 is activated by a single ball 44 and is deactivated by controlling the fluid pressure exerted on the same ball 44. When activated, fluid flowing through the drill string 14 or coiled tubing 30 exits the sub 42 and flows into the wellbore 20. When deactivated, fluid will flow completely through the sub 42 towards the drill bit 16 or 40. The ball 44 is preferably solid and made of nylon, but can be made out of any material that is capable of activating and deactivating the sub 42. The sub 42 may be activated as many times as needed by sending additional balls 44 down the drill string 14 or coiled tubing 30.

The circulation sub 42 comprises an elongate outer member 46 having a longitudinal internal bore 48 extending therethrough. A threaded pin and box end (not shown) may be formed on opposite ends of the sub 42 so that the sub may be incorporated into the bottom hole assembly 22 or 36.

At least one exit port 50 is formed in the wall of the outer member 46 proximate its top end 52. The exit port 50 interconnects the internal bore 48 and an outer surface of the outer member 46. Two exit ports 50 are shown in FIGS. 3-5; however, the outer member 46 may comprise more than two exit ports, if desired.

An elongate inner member 54 is disposed within the internal bore 48 of the outer member 46. The inner member 54 is movable relative to the outer member 46, and has a longitudinal internal channel 56 extending therethrough. The channel 56 opens at a first surface 58 and an opposite second surface 60 of the inner member 54. The channel 56 tapers inwardly proximate its midsection to form a narrowed section 62. The narrowed section 62 terminates at a nozzle 64. The channel 56 is widened again below the nozzle 64.

The nozzle 64 has a smaller diameter than the ball 44. The nozzle 64 tapers inwardly to form a funnel. Alternatively, the nozzle 64 may just comprise a round spout. As described later herein, the ball 44 may seat on the nozzle 64 to block fluid flow within the sub 42. Extrusion of the ball 44 through the nozzle 64 allows fluid to again flow through the sub 42 towards the drill bit 16 or 40.

In one embodiment, the diameter of the nozzle 64 may only be slightly larger than the diameter of the ball 44 so that the ball is not deformed when it is extruded through the nozzle 64. This allows the ball 44, if desired, to activate a second downhole tool positioned below the sub 42 in the bottom hole assembly 22 or 36. The ball 44 may also deform under high pressure in some embodiments.

In another embodiment, the diameter of the nozzle 64 may be decreased, as desired, to control the pressure required to extrude the ball 44 through the nozzle 64. For example, the smaller the diameter of the nozzle 64, the more pressure required to extrude the ball 44. This allows the operator to pump a higher rate of fluid into the wellbore 20 before extruding the ball 44 from the sub 42. When the ball 44 is extruded, fluid pressure within the sub 42 is decreased. As described later herein, this decrease of fluid pressure may deactivate the sub 42.

The rate at which the ball 44 is extruded through the nozzle 64 may also be controlled by varying the strength and size of the ball 44. Preferably, the ball 44 is configured and the nozzle 64 is sized such that the ball 44 is extruded when the fluid pressure within the sub 42 reaches about 1,200 psi.

A spring 66 is positioned within the internal bore 48 of the outer member 46 below the second surface 60 of the inner member 54. Downward movement of the inner member 54 compresses the spring 66. Fluid flowing through the sub 42 enters the internal bore 48, passes through the channel 56, the center of the spring 66, and out a bottom end 68 of the sub 42.

A plurality of locking members 70 are supported by the inner member 54. The locking members 70 are positioned above the nozzle 64 and adjacent the tapered and narrowed section 62 of the channel 56. The locking members 70 releasably maintain the inner and outer members 54 and 46 in a longitudinally fixed relationship. Two locking members 70 are shown in FIGS. 3-5; however, the sub 42 may only have one locking member 70 or more than two locking members, if desired. The locking members 70 comprise an elongate arm 72 attached to a catch member 74 via a horizontal pin 76.

An elongate slot 78 is formed in the outer wall of the inner member 54 that opens towards the inner surface of the outer member 46. The arm 72 of the locking member 70 is positioned vertically within the slot 78. The pin 76 is also positioned within the slot 78. The catch member 74 is supported horizontally within the inner member 54 and extends between the channel 56 and the slot 78. A portion of the catch member 74 extends into the channel 56.

An ear 80 is formed at the end of the arms 72 opposite the end that connects with the catch member 74. The ear 80 shown in FIGS. 3-5 is a square-shaped projection on the end of the arm 72. However, the ear 80 may be formed of other shapes, if needed. The ear 80 may be positioned within a groove 82 formed in the wall of the inner member 54. The groove 82 opens towards a centerline of the outer member 46. As shown in FIGS. 3-5, the outer member 46 may have a single corresponding groove 82 for each locking member 70. Alternatively, the outer member 46 may have an endless annular groove that each of the ears 80 is positioned within.

A hollow sleeve 84 having a series of openings 86 is shown positioned above the inner member 54 in FIG. 5. The sleeve 84 is positioned within the internal bore 48. The openings 86 open into the internal bore 48. The sleeve 84 may be attached to the first surface 58 of the inner member 54 or may be integral with the inner member.

With reference to FIG. 3, the sub 42 is shown in the locked position. When in the locked position, the inner member 54 is locked in place within the outer member 46. The inner member 54 is locked in place because the ears 80 are positioned within the grooves 82. The catch members 74 are also partially extended into the channel 56 in the locked position, and the wall of the inner member 54 seals fluid from entering the exit ports 50. The exit ports 50 are not in fluid communication with the internal bore 48 of the sub 42 when in the locked position.

In operation, an operator at the ground surface 18 (FIG. 1) may lower or pump a ball 44 down the drill string 14 or coiled tubing 30 along with the fluid to activate the sub 42. As shown in FIG. 3, the ball 44 will enter the sub 42 through a top end 52 of the outer member 46 and flow into the opening of the channel 56 at the first surface 58 of the inner member 54. Once in the channel 56, the ball 44 can move the sub 42 to the intermediate position.

With reference to FIG. 4, the sub 42 is shown in the intermediate position. When in the intermediate position, the inner member 54 is unlocked from the outer member 46, but the exit ports 50 are still sealed closed by the wall of the inner member 54.

In operation, when the ball 44 enters the channel 56, it will flow into the narrowed section 62 of the channel 56 where it will engage with the catch members 74. The ball 44 will exert a downward force on the catch members 74, causing them to pull the arms 72 towards a centerline of the outer body 46. This causes the ears 80 to retract out from the grooves 82 and unlock the inner member 54 from the outer member 46.

While the ball 44 is engaged with the catch members 74, the ball will disrupt the flow of fluid through the sub 42. This will cause fluid pressure to build within the channel 56 on the backside of the ball 44. The increased fluid pressure within the channel will force the inner member 54 to move downward within the internal bore 48.

Downward movement of the inner member 54 will pull the arms 72 away from the grooves 82, and compress the spring 66. Downward movement of the inner member 54 will also start to move the inner member 54 into an open position.

With reference to FIG. 5, the sub 42 is shown in the open position. When in the open position, the exit ports 50 are in fluid communication with the internal bore 48 and fluid is permitted to exit the sub 42.

In operation, the fluid pressure will push the ball 44 past the catch members 74 and seat the ball 44 on the nozzle 64. The ball 44 will block all or almost all fluid from flowing through the channel 56. This will increase fluid pressure within the channel 56 and cause the inner member 54 to move farther downward within the internal bore 48, further compressing the spring 66. The downward movement of the inner member 54 will also pull the arms 72 farther away from the grooves 82.

As the inner member 54 moves downward, it pulls the sleeve 84 and openings 86 in-line with the exit ports 50, to position the sub 42 in the open position. Fluid flowing through the drill string 14 or coiled tubing 30 and into the sleeve 84 may pass through the openings 86 and exit the sub 42 through the exit ports 50. Fluid exiting the sub 42 will flow into the wellbore 20 and increase circulation within the wellbore.

The ball 44 is shown seated on the nozzle 64 in FIG. 5. However, the inner member 54 may move downward far enough such that it is in the open position before the ball 44 becomes seated on the nozzle 64. For example, the inner member 54 may move into the open position while the ball 44 is still engaged with the catches 74.

After circulation has been increased within the wellbore 20 as desired, an operator at the ground surface 18 (FIG. 1) may decide to deactivate the sub 42. To do this, the operator may decrease the rate of fluid flowing into the sub 42 or stop fluid from flowing into the sub 42 altogether. This will decrease pressure within the sub 42 and permit the spring 66 to relax.

As the spring 66 relaxes, it pushes the inner member 54 upwards within internal bore 48. Upward movement of the inner member 54 will move the locking members 70 towards the grooves 82. Because the ball 44 is positioned below the catch members 74, the ball 44 is no longer forcing the catch members 74 to pull the arms 72 towards the centerline of the outer body 46. This allows the ears 80 to be supported against the inner surface of the outer member 46, as shown in FIG. 5. Due to this, as the inner member 54 moves the locking members 70 upwards, the ears 80 will re-enter the grooves 82 upon reaching them.

Upward movement of the inner member 54 will also push the sleeve 84 away from the exit ports 50, and the wall of the inner member 54 will seal the exit ports 50 closed. Once the exit ports 50 are sealed, fluid will continue to flow through the sub 42 towards the drill bit 16 or 40.

Once the inner member 54 has returned to the locked position, fluid may be increased within the sub 42 to extrude the ball 44 through the nozzle 64. This is done by increasing the fluid pressure within in the sub 42 until the ball 44 can no longer withstand the pressure. When this occurs, the ball 44 will be forced through the nozzle 64 and continue through the channel 56 and the center of the spring 66 until it exits the bottom end 68 of the sub 42. The sub 42 is not reactivated because the catch members 74 prevent the ball 44 from moving upward within the sub. The locking elements 70 may only be disengaged from the locked position in response to downward, but not upward, pressure from the ball 44.

The sub 42 may also be deactivated by extruding the ball 44 prior to moving the inner member 54 to the locked position. To do this, the operator will increase the fluid pressure within the sub 42 while the inner member 54 is still in the open position. Fluid pressure is increased until the ball 44 is extruded through the nozzle 64. After the ball 44 is extruded, the fluid pressure within the sub 42 will decrease, allowing the spring 66 to relax and the inner member 54 to move back to the locked position.

Changes may be made in the construction, operation and arrangement of the various parts, elements, steps and procedures described herein without departing from the spirit and scope of the invention as described in the following claims.

The invention claimed is:

1. A circulating sub comprising:

an elongate outer member having a longitudinal internal bore extending therethrough and at least one exit port;

an elongate inner member disposed within the internal bore and having an internal channel extending therethrough, in which a nozzle is formed within the channel;

a plurality of locking elements adapted to releasably maintain the inner and outer members in a longitudinally fixed relationship, each locking element comprising:

an elongate arm having a projecting ear positionable within a groove formed within the internal bore; and a catch member attached to the arm and partially extending within the channel;

wherein the inner member is configured to move relative the outer body such that the inner member is movable between:

a locked position, in which fluid does not pass through the exit port; and an open position, in which fluid passes through the exit port.

2. The circulating sub of claim 1 in which when the inner member is in the locked position, the ears are positioned within the grooves and the exit port is not in fluid communication with the internal bore.

3. The circulating sub of claim 1 in which the inner member is also movable to an intermediate position, in which a ball is engaged with the catch members and the ears are not positioned in the grooves.

4. The circulating sub of claim 1 in which when the inner member is in the open position, a ball is seated on the nozzle, the ears are not positioned within the grooves and the exit port is in fluid communication with the internal bore.

5. The circulating sub of claim 1 further comprising a spring disposed within the internal bore below the inner member, in which the spring is compressed when the inner member is in the open position.

6. The circulation sub of claim 5 in which the spring is relaxed when the inner member is in the locked position.

7. The circulating sub of claim 1 further comprising a hollow sleeve having at least one opening positioned above the inner member that is movable with the inner member.

8. The circulating sub of claim 1 in which each locking element may be disengaged from its locked position by a ball in response to downward, but not upward, pressure applied thereto.

9. A method of using the circulation sub of claim 1 while it is carried by an underground tubular string, comprising:

lowering a ball within the tubular string until the ball engages with the catch members; and increasing fluid pressure above the ball so that the inner member is moved from the locked position to the open position.

10. The method of claim 9 further comprising:

releasing fluid from the circulation sub through the exit port and into a wellbore surrounding the sub;

decreasing fluid pressure within the circulation sub such that the inner member is moved into the locked position; and increasing fluid pressure within the sub until the ball is extruded through a nozzle.

11. The method of claim 10 further comprising:

lowering the extruded ball into a downhole tool positioned below the circulation sub.

12. A circulation sub system comprising:

an elongate tubular string that extends underground; and the circulation sub of claim 1, in which the sub is positioned within the tubular string.

13. The circulation sub system of claim 12 in which a ball is engaged with the catches.

14. The circulation sub system of claim 12 in which a ball is seated on the nozzle.

15. The circulation sub system of claim 12 in which the elongate tubular string is coiled tubing.

16. The circulation sub system of claim 12 in which the elongate tubular string is formed from rigid pipe sections.

* * * * *